US006776238B2

(12) United States Patent
Dusterhoft et al.

(10) Patent No.: US 6,776,238 B2
(45) Date of Patent: Aug. 17, 2004

(54) SINGLE TRIP METHOD FOR SELECTIVELY FRACTURE PACKING MULTIPLE FORMATIONS TRAVERSED BY A WELLBORE

(75) Inventors: Ronald G. Dusterhoft, Katy, TX (US); Syed Hamid, Dallas, TX (US); Robert Ken Michael, Frisco, TX (US); Roger Lynn Schultz, Aubrey, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 36 days.

(21) Appl. No.: 10/119,189

(22) Filed: Apr. 9, 2002

(65) Prior Publication Data

US 2003/0188871 A1 Oct. 9, 2003

(51) Int. Cl.[7] ..... E21B 43/26
(52) U.S. Cl. ..... 166/308; 166/177.5; 166/227
(58) Field of Search ..... 166/308, 177.5, 166/313, 227

(56) References Cited

U.S. PATENT DOCUMENTS

| | | | | |
|---|---|---|---|---|
| 1,975,162 A | | 10/1934 | Layne | |
| 2,342,913 A | | 2/1944 | Williams et al. | |
| 2,344,909 A | | 3/1944 | Williams et al. | |
| 4,102,395 A | | 7/1978 | Robinson | |
| 4,558,742 A | | 12/1985 | Huang et al. | |
| 4,932,474 A | | 6/1990 | Schroeder, Jr. et al. | |
| 4,945,991 A | | 8/1990 | Jones | 166/278 |
| 5,082,052 A | | 1/1992 | Jones et al. | 166/51 |
| 5,113,935 A | | 5/1992 | Jones et al. | 166/51 |
| 5,161,613 A | | 11/1992 | Jones | 166/242 |
| 5,161,618 A | | 11/1992 | Jones et al. | 166/308 |
| 5,165,476 A | | 11/1992 | Jones | |
| 5,333,688 A | | 8/1994 | Jones et al. | 166/278 |
| 5,355,956 A | | 10/1994 | Restarick | 166/296 |
| 5,386,874 A | * | 2/1995 | Laramay et al. | 166/300 |
| 5,390,966 A | | 2/1995 | Cox et al. | 285/137.1 |
| 5,419,394 A | | 5/1995 | Jones | 166/51 |
| 5,443,117 A | | 8/1995 | Ross | 166/51 |
| 5,476,143 A | | 12/1995 | Sparlin et al. | 166/233 |
| 5,515,915 A | | 5/1996 | Jones et al. | 166/51 |
| 5,588,487 A | | 12/1996 | Bryant | 166/51 |

(List continued on next page.)

FOREIGN PATENT DOCUMENTS

| | | | |
|---|---|---|---|
| EP | 1 132 571 | 9/2001 | E21B/43/267 |
| WO | WO 99/12630 | 3/1999 | B01D/29/15 |
| WO | WO 00/61913 | 10/2000 | E21B/43/04 |
| WO | WO 01/14691 | 3/2001 | E21B/43/08 |
| WO | WO 01/44619 | 6/2001 | E21B/43/04 |
| WO | WO 02/10554 | 2/2002 | E21B/43/26 |

OTHER PUBLICATIONS

"Mechanical Fluid–Loss Control Systems Used During Sand Control Operations," H.L. Restarick of Otis Engineering Corp., 1992.

(List continued on next page.)

*Primary Examiner*—David Bagnell
*Assistant Examiner*—Jennifer R. Dougherty
(74) *Attorney, Agent, or Firm*—Lawrence R. Youst

(57) ABSTRACT

Screen assemblies (40, 42) and a single trip method for selectively fracturing multiple formations (14, 16) traversed by a wellbore (32) are disclosed. Each formation (14, 16) has a screen assembly (40, 42) having a plurality of valves (60, 66) positioned adjacent thereto. During the treatment process, the formations (14, 16) are selectively treated with a treatment fluid that is pumped into the interior of the adjacent screen assembly (40, 42). The valves (60, 66) of the respective screen assemblies (40, 42) progressively allow the treatment fluid to exit from the interior to the exterior of the screen assemblies (40, 42) such that each formation (14, 16) is progressively fractured.

53 Claims, 13 Drawing Sheets

U.S. PATENT DOCUMENTS

| | | | | |
|---|---|---|---|---|
| 5,636,691 | A | 6/1997 | Hendrickson et al. | 166/278 |
| 5,699,860 | A * | 12/1997 | Grundmann | 166/280 |
| 5,755,286 | A | 5/1998 | Ebinger | 166/281 |
| 5,842,516 | A | 12/1998 | Jones | 166/56 |
| 5,848,645 | A | 12/1998 | Jones | 166/280 |
| 5,868,200 | A | 2/1999 | Bryant et al. | 166/51 |
| 5,890,533 | A | 4/1999 | Jones | 166/51 |
| 5,921,318 | A | 7/1999 | Ross | 166/250.17 |
| 5,934,376 | A | 8/1999 | Nguyen et al. | 166/278 |
| 6,003,600 | A | 12/1999 | Nguyen et al. | 166/281 |
| 6,047,773 | A | 4/2000 | Zeltmann et al. | 166/281 |
| 6,059,032 | A | 5/2000 | Jones | 166/278 |
| 6,116,343 | A | 9/2000 | Van Petegem et al. | 166/297 |
| 6,125,933 | A | 10/2000 | Ross | 166/250.01 |
| 6,220,345 | B1 | 4/2001 | Jones et al. | 166/51 |
| 6,227,303 | B1 | 5/2001 | Jones | 166/378 |
| 6,230,803 | B1 | 5/2001 | Morton et al. | 166/278 |
| 6,343,651 | B1 | 2/2002 | Bixenman | 166/278 |
| 6,450,263 | B1 | 9/2002 | Schwendemann | |
| 6,464,007 | B1 | 10/2002 | Jones | |
| 6,516,881 | B2 | 2/2003 | Hailey, Jr. | |
| 6,516,882 | B2 | 2/2003 | McGregor et al. | |
| 6,540,022 | B2 * | 4/2003 | Dusterhoft et al. | 166/278 |
| 6,543,538 | B2 * | 4/2003 | Tolman et al. | 166/284 |
| 6,547,011 | B2 * | 4/2003 | Kilgore | 166/387 |
| 6,557,634 | B2 | 5/2003 | Hailey, Jr. et al. | |
| 6,581,689 | B2 | 6/2003 | Hailey, Jr. | |
| 6,588,506 | B2 | 7/2003 | Jones | |
| 6,588,507 | B2 | 7/2003 | Dusterhoft et al. | |

OTHER PUBLICATIONS

"Sand Control Screens," Halliburton Energy Services, 1994.

"Frac Pack Technology Still Evolving," Charles D. Ebinger of Ely & Associates Inc.; Oil & Gas Journal, Oct. 23, 1995.

"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.

"Caps$^{SM}$ Sand Control Service for Horizontal Completions Improves Gravel Pack Reliability and Increases Production Potential from Horizontal Completions," Halliburton Energy Services, Inc., Aug., 2000.

"CAPS$^{SM}$ Concentric Annular Packing Service for Sand Control," Halliburton Energy Services, Inc., Aug., 2000.

"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.

* cited by examiner

SINGLE TRIP METHOD FOR SELECTIVELY FRACTURE PACKING MULTIPLE FORMATIONS TRAVERSED BY A WELLBORE

TECHNICAL FIELD OF THE INVENTION

This invention relates, in general, to the treatment of production intervals traversed by a wellbore to stimulate hydrocarbon production and prevent the production of fine particulate materials and, in particular, to a single trip method for selectively fracture packing multiple formations traversed by the wellbore.

BACKGROUND OF THE INVENTION

It is well known in the subterranean well drilling and completion art that hydraulic fracturing of a hydrocarbon formation is sometimes necessary to increase the permeability of the production interval adjacent the wellbore. According to conventional practice, a fracture fluid such as water, oil, oil/water emulsion, gelled water, gelled oil, $CO_2$ and nitrogen foams or water/alcohol mixture is pumped down the work string with sufficient volume and pressure to open multiple fractures in the production interval. The fracture fluid may carry a suitable propping agent, such as sand, gravel or engineered proppants, into the fractures for the purpose of holding the fractures open following the fracturing operation.

During the fracture operation, the fracture fluid must be forced into the formation at a flow rate great enough to generate the required pressure to fracture the formation allowing the entrained proppant to enter the fractures and prop the formation structures apart. The proppants produce channels which will create highly conductive paths reaching out into the production interval, which increases the reservoir permeability in the fracture region. As such, the success of the fracture operation is dependent upon the ability to inject large volumes of hydraulic fracture fluid along the entire length of the formation at a high pressure and at a high flow rate.

It has been found, however, that it is difficult to achieve the desired stimulation of multiple zones traversed by a single wellbore. Specifically, when multiple production intervals are fractured at the same time, one of the zones will typically dominate and take a vast majority of the treatment fluids. While this dominant zone may be properly stimulated, the other less dominant zones may receive little or no treatment fluids resulting in little or no stimulation.

Therefore a need has arisen for a method of selectively frac packing multiple zones traversed by a wellbore such that tailored fracture treatments may be preformed on each of the zones. A need has also arisen for such a method that is capable of creating fractures along the entire length of each of the zones. Further a need has arisen for such a method that is capable of stimulating each of the zones to enhance production and capable of packing each of the production intervals to prevent the production of fine particulate materials when production commences.

SUMMARY OF THE INVENTION

The present invention disclosed herein comprises a single trip method of selectively frac packing multiple zones traversed by a wellbore such that tailored fracture treatments may be preformed on each of the zones. The method of the present invention is capable of creating fractures along the entire length of each of the zones. Further, the method of the present invention is capable of stimulating each of the zones to enhance production and is also capable of packing each of the production intervals to prevent the production of fine particulate materials when production commences.

In the single trip method of the present invention, a first screen assembly having a plurality of first valves is located within the wellbore proximate a first formation and a second screen assembly having a plurality of second valves is located within the wellbore proximate a second formation. A service tool is then run downhole and positioned proximate the first formation such that a first fracture treatment fluid may be pumped through the service tool into of the first screen assembly. The first valves are then progressively operated to establish fluid communication from the interior to the exterior of the first screen assembly such that the first formation is progressively fractured. The service tool is then repositioned proximate the second formation such that a second fracture treatment fluid may be pumped into the interior of the second screen assembly. Thereafter, the second valves are progressively operated to establish fluid communication from the interior to the exterior of the second screen assembly such that the second formation is progressively fractured.

The present invention allows for a tailored treatment regimen to be delivered to each formation. As an example, the first and second fracture treatment fluids may have substantially the same composition or may have different compositions. Likewise, the first and second fracture treatment fluids may have substantially the same viscosity or may have different viscosities. In addition, the first and second fracture treatment fluids may be injected at substantially the rate or may be injected at different rates.

The first and second fracture treatment fluids may include solid agents therein. The solid agents not only prop the fractures in the first and second formations to create a highly permeable path to the wellbore, but also, pack the wellbore adjacent to the first and second formations to prevent the production of fines therethrough.

During and following the treatment process, the flow of fluids from the exterior to the interior of the first and second screen assemblies through the first and second valves is prevented as the first and second valves are preferably one-way valves only allowing fluid flow from the interior to the exterior of the first and second screen assemblies. In addition, during the treatment process, the flow of fluids between the interior and the exterior of the first and second screen assemblies through the openings in the base pipes of the first and second screen assemblies is prevented with seal members. Following the treatment process, however, the seal members must be removed. Depending upon the type of seal members used, the removal process may involve combustion, vibration, chemical reaction, mechanical removal or the like.

The progressive operation of the first valves may progress from the far end, the end having a greater hole depth, to the near end, the end having a lesser hole depth, of the first screen assembly. Alternatively, the progressive operation of the first valves may progress from the near end to the far end of the first screen assembly. Likewise, the progressive operation of the second valves may progress from the far end to the near end or the near end to the far end of the second screen assembly.

The first and second valves may be progressively operated in response to pressure within their respective screen assemblies. Alternatively, the progressive operation of the first and second valves may be achieved via wireless telemetry, a direct electrical connection, a hydraulic connection or the like.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
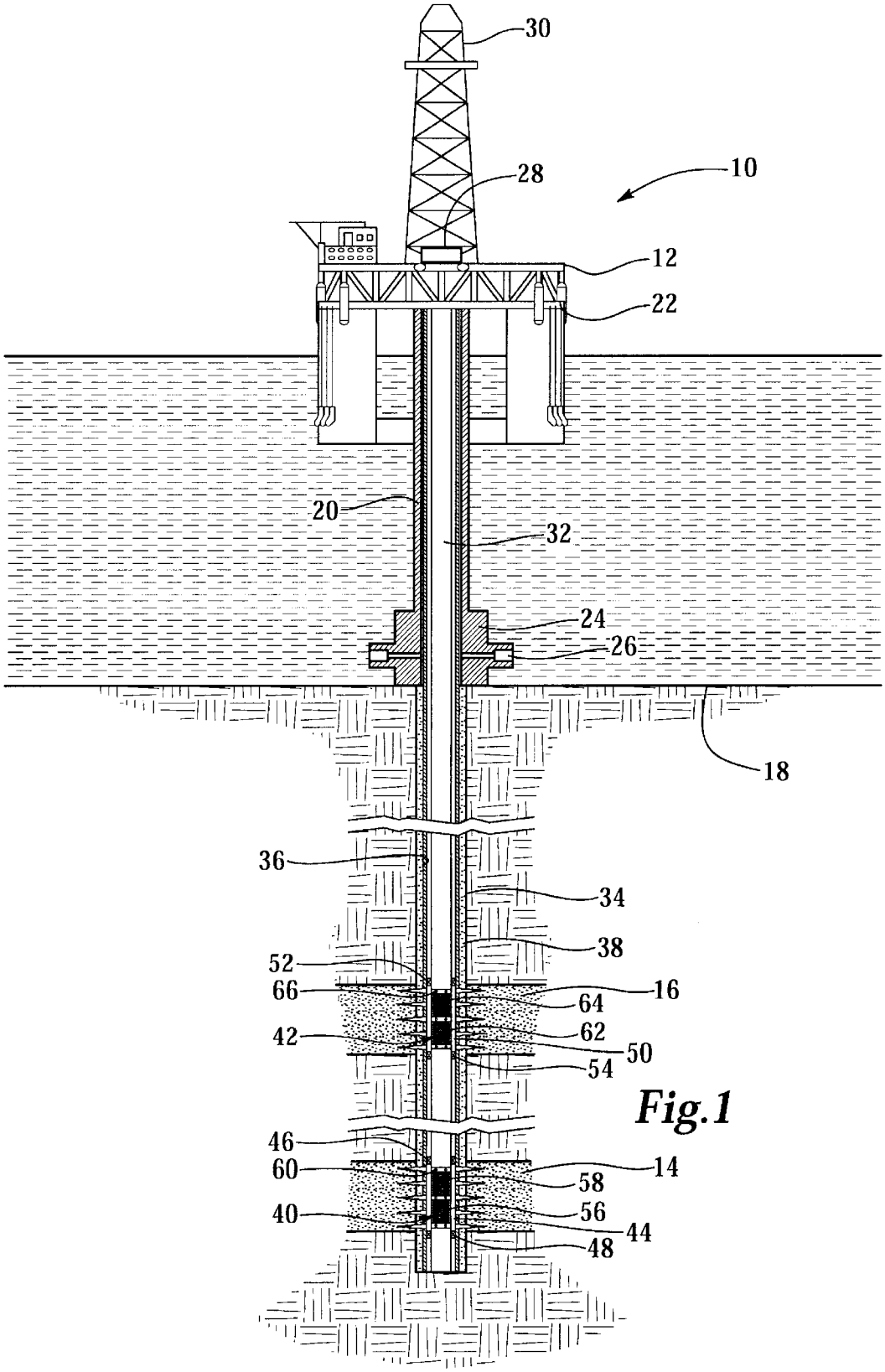
FIG. 1 is a schematic illustration of an offshore oil and gas platform operating a pair of sand control screen assemblies of the present invention.

Referring initially to FIG. 1, a pair of sand control screen assemblies used during the treatment of multiple intervals of a wellbore in a single trip are operating from an offshore oil and gas platform that is schematically illustrated and generally designated 10. A semi-submersible platform 12 is centered over a pair of submerged oil and gas formations 14, 16 located below a sea floor 18. A subsea conduit 20 extends from a deck 22 of the platform 12 to a wellhead installation 24 including blowout preventers 26. Platform 12 has a hoisting apparatus derrick 30 for raising and lowering pipe strings such as a work string 32.

A wellbore 34 extends through the various earth strata including formations 14, 16. A casing 36 is cemented within wellbore 34 by cement 38. Work string 32 includes various tools such as a sand control screen assembly 40, which is positioned within production interval 44 between packers 46, 48 and adjacent to formation 14, and sand control screen assembly 42, which is positioned within production interval 50 between packers 52, 54 and adjacent to formation 16. Sand control screen assembly 40 includes sand control screens 56, 58 and a plurality of valves 60. Sand control screen assembly 42 includes sand control screens 62, 64 and a plurality of valves 66. Once sand control screen assemblies 40, 42 are in place a treatment fluid containing sand, gravel, proppants or the like is pumped down work string 32 such that formation 14 is fractured and production interval 44 is packed. Once this occurs, formation 16 is fractured and production interval 50 is packed.

Even though FIG. 1 depicts a vertical well, it should be noted by one skilled in the art that the sand control screen assemblies of the present invention are equally well-suited for use in deviated wells, inclined wells or horizontal wells. Also, even though FIG. 1 depicts an offshore operation, it should be noted by one skilled in the art that the sand control screen assemblies of the present invention are equally well-suited for use in onshore operations. Also, even though FIG. 1 depicts two formations, it should be understood by one skilled in the art that the treatment processes of the present invention are equally well-suited for use with any number of formations.

Figure 2:
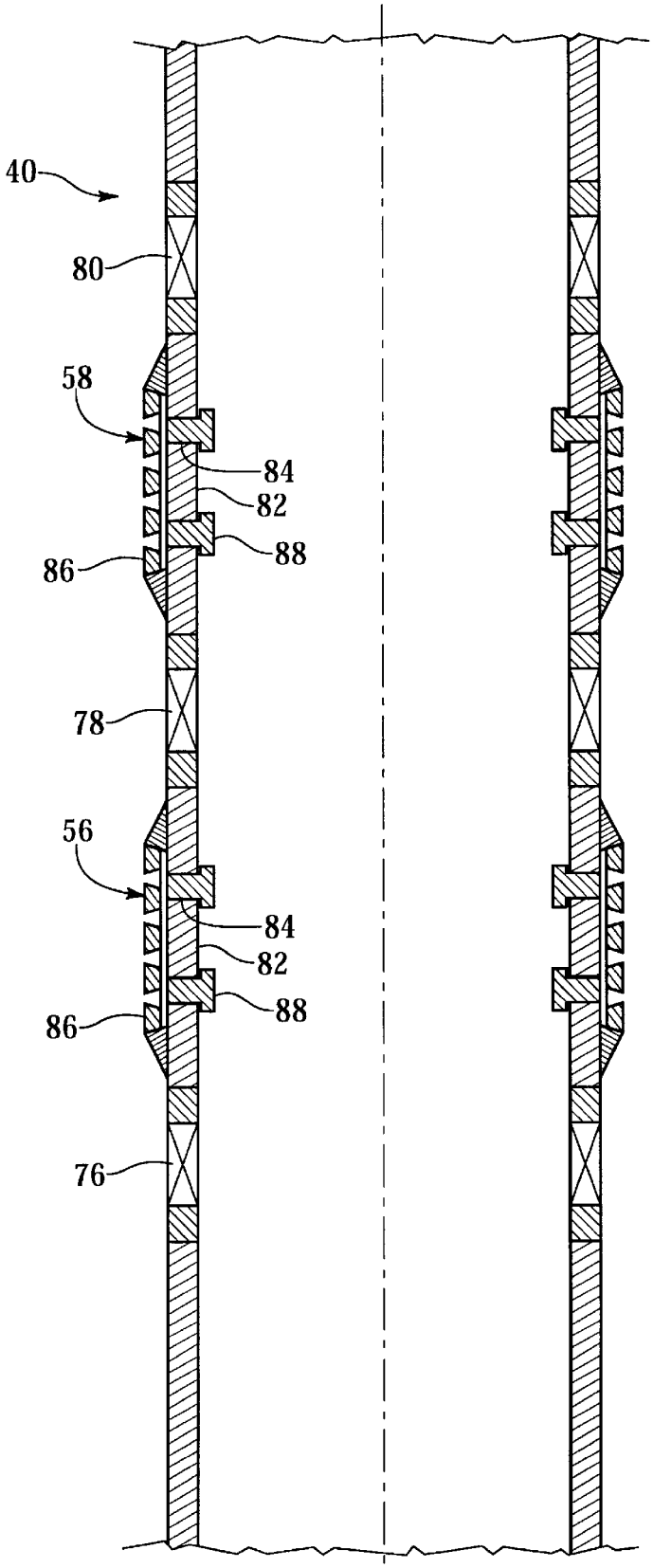
FIG. 2 is a cross sectional view of a sand control screen assembly of the present invention having a plurality of pressure sensitive valves and sand control screens.

Referring now to FIG. 2, therein is depicted a more detailed illustration of sand control screen assembly 40 of the present invention. Sand control screen assembly 40 includes a pair of sand control screens 56, 58 and a plurality of valves 76, 78, 80. Each of the sand control screens 56, 58 includes a base pipe 82 that has a plurality of openings 84 which allow the flow of production fluids into sand control screen assembly 40. The exact number, size and shape of openings 84 are not critical to the present invention, so long as sufficient area is provided for fluid production and the integrity of base pipe 82 is maintained.

Spaced around each base pipe 82 is a plurality of ribs (not pictured) that are generally symmetrically distributed about the axis of base pipes 82. The ribs may have any suitable cross section including a cylindrical cross section, a rectangular cross section, a triangular cross section or the like. Additionally, it should be understood by one skilled in the art that the exact number of ribs will be dependant upon the diameter of base pipe 82 as well as other design characteristics that are well known in the art.

Wrapped around the ribs of each base pipe 82 is a screen wire 86. Screen wire 86 forms a plurality of turns having gaps therebetween through which formation fluids flow. The number of turns and the gap between the turns are determined based upon the characteristics of the formation from which fluid is being produced and the size of the gravel to be used during the treatment operation. Together, the ribs and screen wire 86 may form a sand control screen jacket which is attached to each base pipe 82 by welding or other suitable techniques. Disposed within openings 84 of base pipes 82 are seal members 88 depicted as plugs which initially prevent fluid flow through openings 84 of base pipes 82 as will be explained in more detail below.

It should be understood by those skilled in the art that while FIG. 2 has depicted a wire wrapped sand control screens, other types of filter media could alternatively be used in conjunction with the apparatus of the present invention, including, but not limited to, a fluid-porous, particulate restricting, sintered metal material such as a plurality of layers of a wire mesh that are sintered together to form a porous sintered wire mesh screen designed to allow fluid flow therethrough but prevent the flow of particulate materials of a predetermined size from passing therethrough.

In the illustrated embodiment, sand control screen assembly 40 includes valves 76, 78, 80. Valves 76, 78, 80 are preferably one-way valves that selectively allow fluid to flow from the interior of sand control screen assembly 40 to the exterior of sand control screen assembly 40. Valves 76, 78, 80 may be progressively actuated using a variety of known techniques such as sending a signal via a direct electrical connection, fiber optics, hydraulics, wireless telemetry including pressure pulses, electromagnetic waves or acoustic signals and the like. Valves 76, 78, 80 are preferably pressure actuated one-way valves which prevent fluid flow from the exterior to the interior of sand control screen assembly 40 and are pressure actuatable to allow fluid flow from the interior to the exterior of sand control screen assembly 40.

Figure 3:
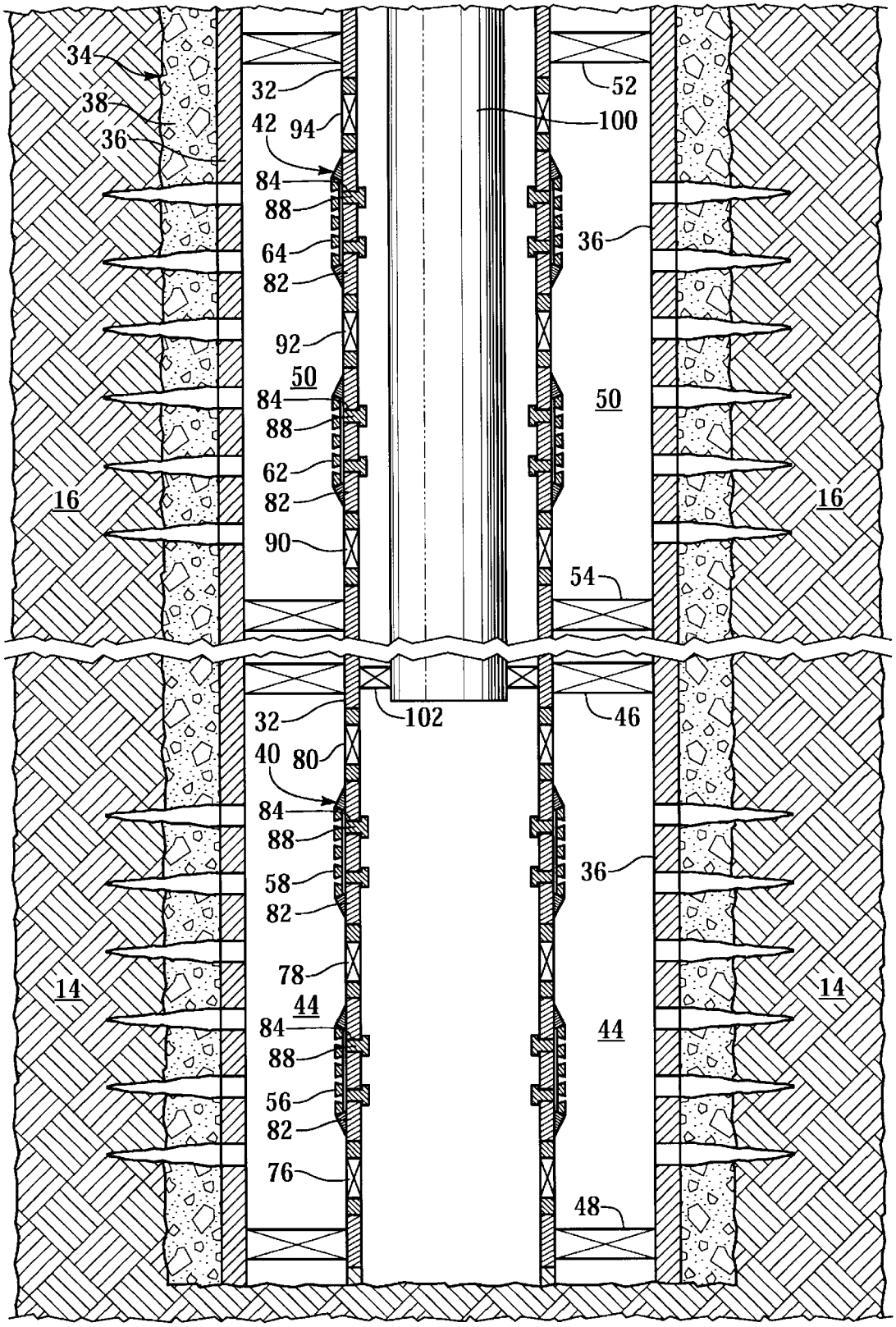
FIG. 3 is a half sectional view of a downhole production environment including two production intervals each having a sand control screen assembly of the present invention associated therewith before a downhole treatment process.

Referring now to FIG. 3, to begin the completion process, interval 44 adjacent to formation 14 is isolated. Packer 46 seals the near end of interval 44 and packer 48 seals the far end of interval 44. Likewise, production interval 50 adjacent to formation 16 is isolated. Packer 52 seals the near end of production interval 50 and packer 54 seals the far end of production interval 50.

As illustrated, when the treatment operation is a sequential fracture pack operation, the objective is to enhance the permeability of formation 14 by delivering a treatment fluid containing proppants at a high flow rate and in a large volume above the fracture gradient of formation 14 such that fractures may be formed within formation 14 and held open by the proppants. The fracture operation for formation 14 can be specifically tailored to achieve the desired stimulation of formation 14 based upon the formation characteristics. In addition, a frac pack also has the objective of preventing the production of fines by packing interval 44 with the proppants. Thereafter, the permeability of formation 16 is enhanced by fracturing formation 16 using a fracture treatment that is specifically tailored to achieve the desired stimulation of formation 16 based upon the formation characteristics. In addition, production interval 50 is packed with the proppants to prevent the production of fines therethrough.

To begin this treatment process, sand control screen assembly 40 including sand screens 56 and 58 and valves 76, 78, 80 is positioned within casing 36 adjacent to formation 14. Valves 76, 78, 80 are preferably pressure actuated one-way valves. Likewise, sand control screen assembly 42 including sand screens 62 and 64 and valves 90, 92, 94 is positioned within casing 36 adjacent to formation 16. Valves 90, 92, 94 are preferably pressure actuated one-way valves.

Seal members 88 of sand control screen assemblies 40 and 42, which are illustrated as plugs, prevent fluid flow through sand control screen assemblies 40 and 42. A service tool 100 is operably positioned within work string 32. Additionally, seal element 102 is coupled to service tool 100. Seal element 102 contacts the interior of work string 32 forming a seal, thereby preventing fluid flow into the annulus between work string 32 and service tool 100.

Figure 4:
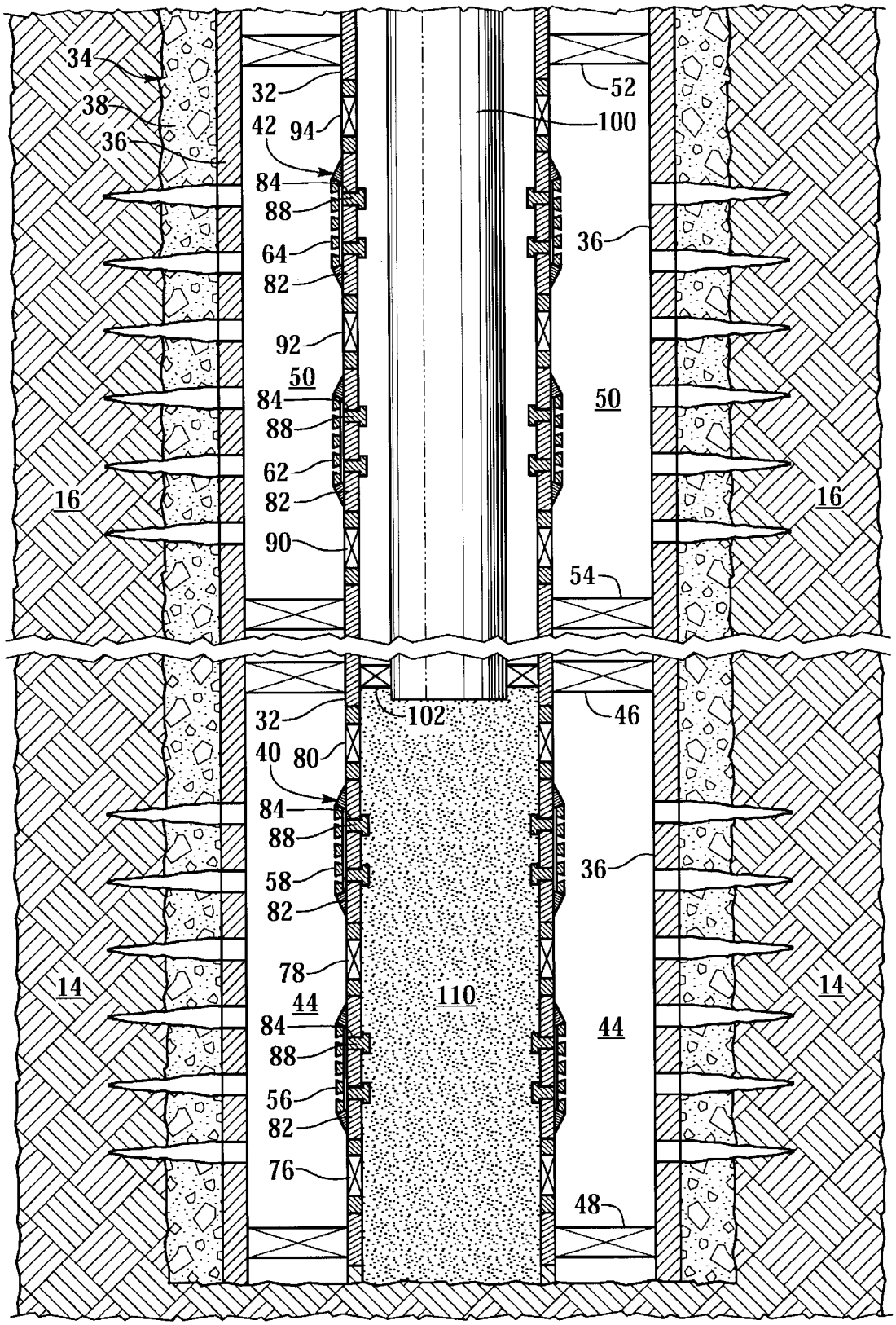
FIG. 4 is a half sectional view of a downhole production environment including two production intervals each having a sand control screen assembly of the present invention associated therewith during a first phase of a downhole treatment process.

Referring now to FIG. 4, in the initial phase of the treatment process of the present invention, the interior of sand control screen assembly 40 is filled with a treatment fluid. This is achieved by pumping treatment fluid downhole via service tool 100. The treatment fluid may be any appropriate fracturing fluid such as oil, water, an oil/water emulsion, gelled water or gelled oil based fracture fluid having a relatively high viscosity to enhance the fracturing process. Preferably, the treatment fluid includes solid agents 110 such as sand, gravel or proppants.

In the illustrated embodiment, pressure actuated one-way valves 76, 78, 80 are progressively actuated to allow the treatment fluid to travel from the interior of screen assembly 40 into interval 44 and formation 14. As stated above, there are numerous ways to progressively actuate valves 76, 78, 80. In the preferred method, as illustrated, the pressure created by the treatment fluid within screen assembly 40 progressively triggers the actuation of pressure actuated one-way valves 76, 78, 80. One way to implement this method is to position pressure actuated one way valves 76, 78, 80 along screen assembly 40 such that the pressure required to actuate pressure actuated one-way valves 76, 78, 80 progressively increases from one end of interval 44 to the other end of interval 44. For example, each adjacent pressure actuated one-way valve may be set to actuate at an incremental pressure above the prior pressure actuated one-way valve such as at increments of between about 50–100 psi. This assures a proper progression of the treatment by preventing any out of sequence activations. In addition, this approach is particularly advantageous in that the incremental pressure increase of adjacent pressure actuated one-way valves helps to insure that the entire formation is fractured.

Figure 5:
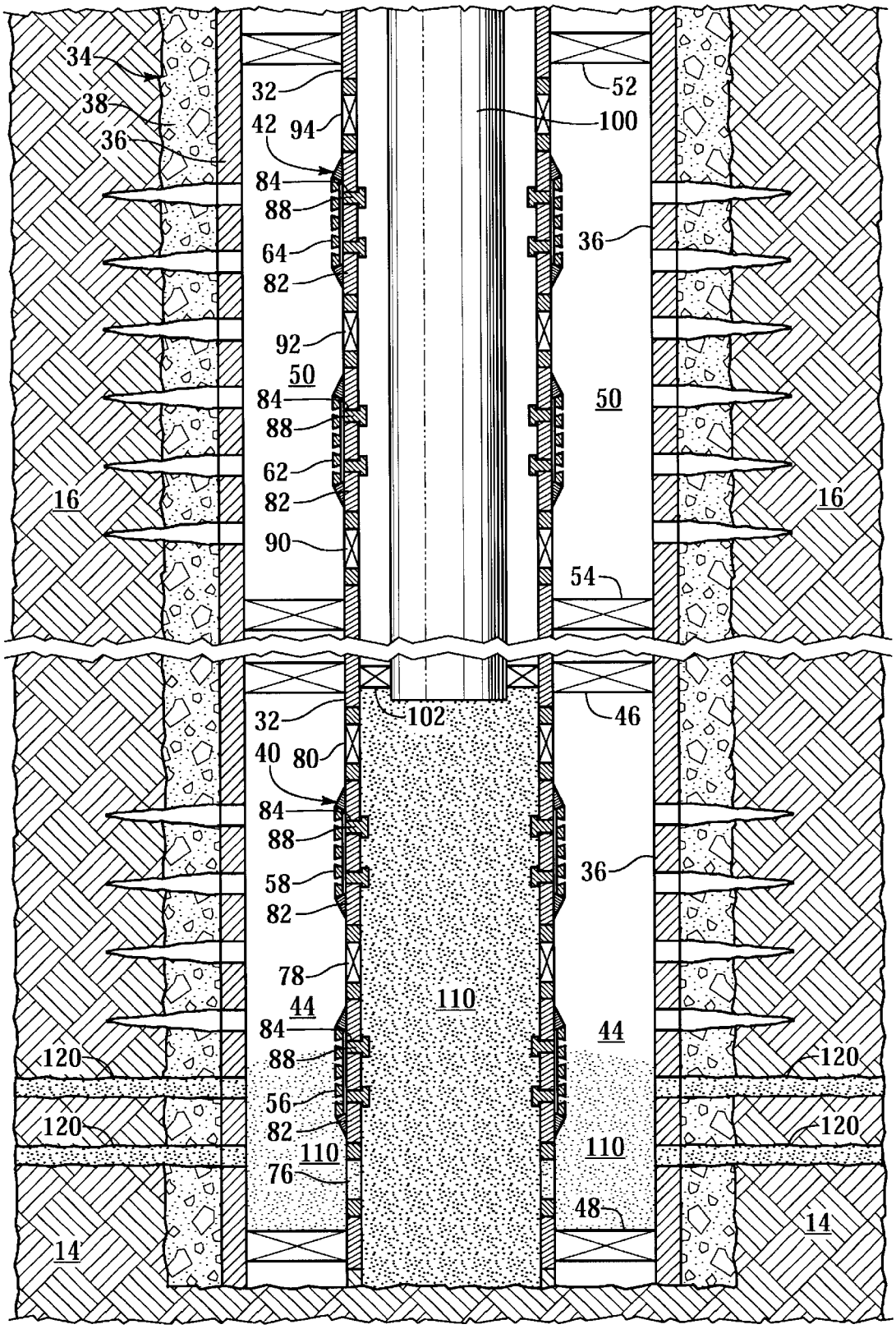
FIG. 5 is a half sectional view of a downhole production environment including two production intervals each having a sand control screen assembly of the present invention associated therewith during a second phase of a downhole treatment process.

Referring now to FIG. 5, the treatment fluid is continuously pumped at a high flow rate and in a large volume into screen assembly 40 such that pressure begins to build within screen assembly 40. At this point, pressure actuated one-way valve 76 is actuated which allows the treatment fluid to travel from the interior of screen assembly 40 into interval 44 through pressure actuated one-way valve 76. It should be noted that pressure actuated one-way valves 78, 80 remain closed.

As treatment fluid flows from the interior of screen assembly 40 through one-way valve 76 and into production interval 44, fractures 120 are formed in formation 14 beginning at the far end of the interval 44. Solid agents 110 in the treatment fluid travel into the newly created fracture 120 to prop the fractures open and create a path of high permeability back to wellbore 34. As fractures 120 cease to propagate into formation 14, the solid agents 110 begin to screen out in production interval 44 between sand control screen assembly 40 and casing 36 around valve 76 and form a gravel pack therein which filters particulate matter out of production fluids once production begins.

Figure 6:
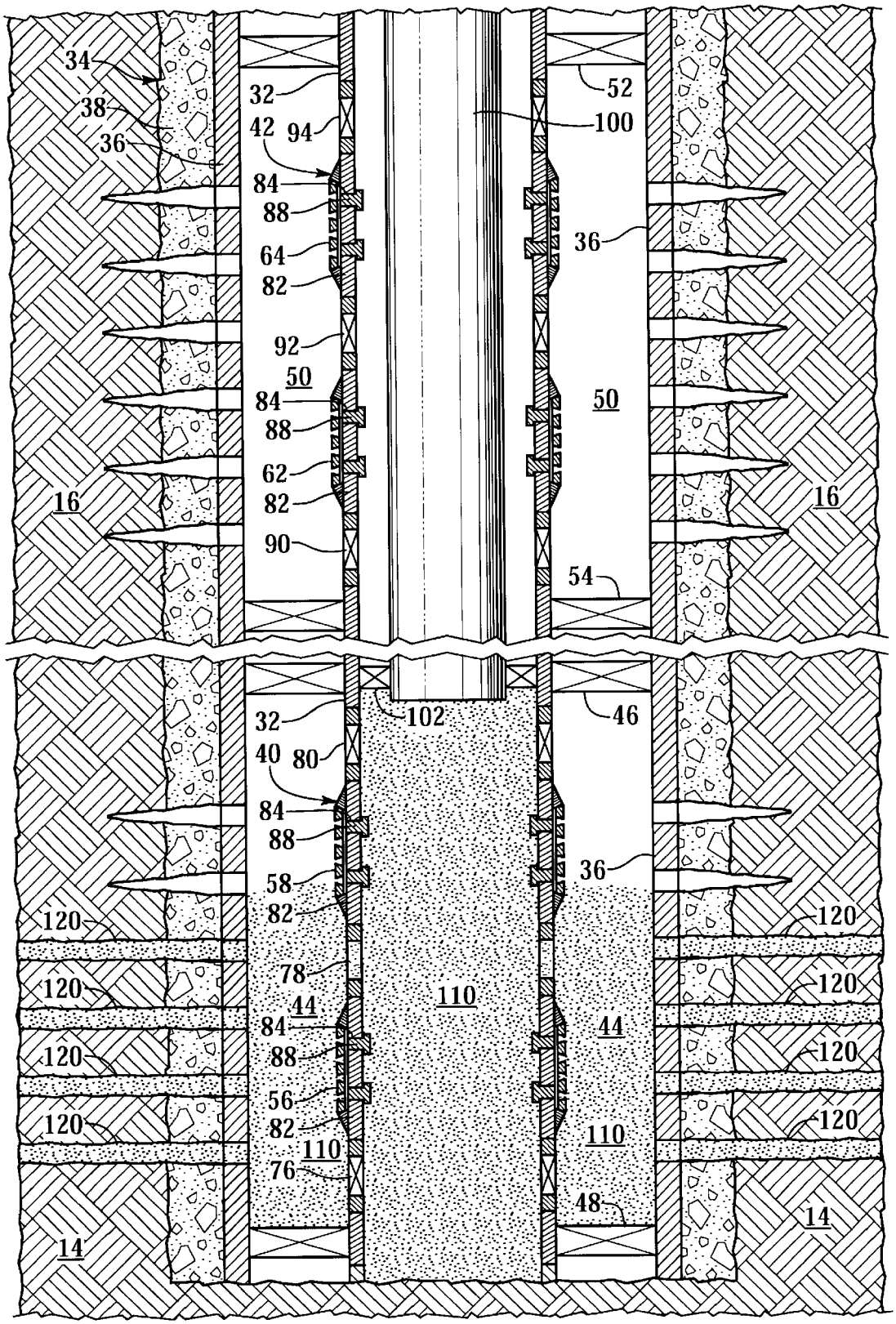
FIG. 6 is a half sectional view of a downhole production environment including two production intervals each having a sand control screen assembly of the present invention associated therewith during a third phase of a downhole treatment process.

As this screen out occurs around valve 76 and treatment fluid continues to be pumped at a high flow rate and in a large volume, pressure begins to build inside of sand control screen assembly 40 which actuates pressure actuated one-way valve 78. When valve 78 opens, the treatment fluid preferably exits sand control screen assembly 40 therethrough which lowers the pressure of valve 76 causing valve 76 to close preventing fluid return from the exterior to the interior of sand control screen assembly 40. As best seen in FIG. 6, the treatment fluid exiting valve 78 fractures the next portion of formation 14.

Figure 7:
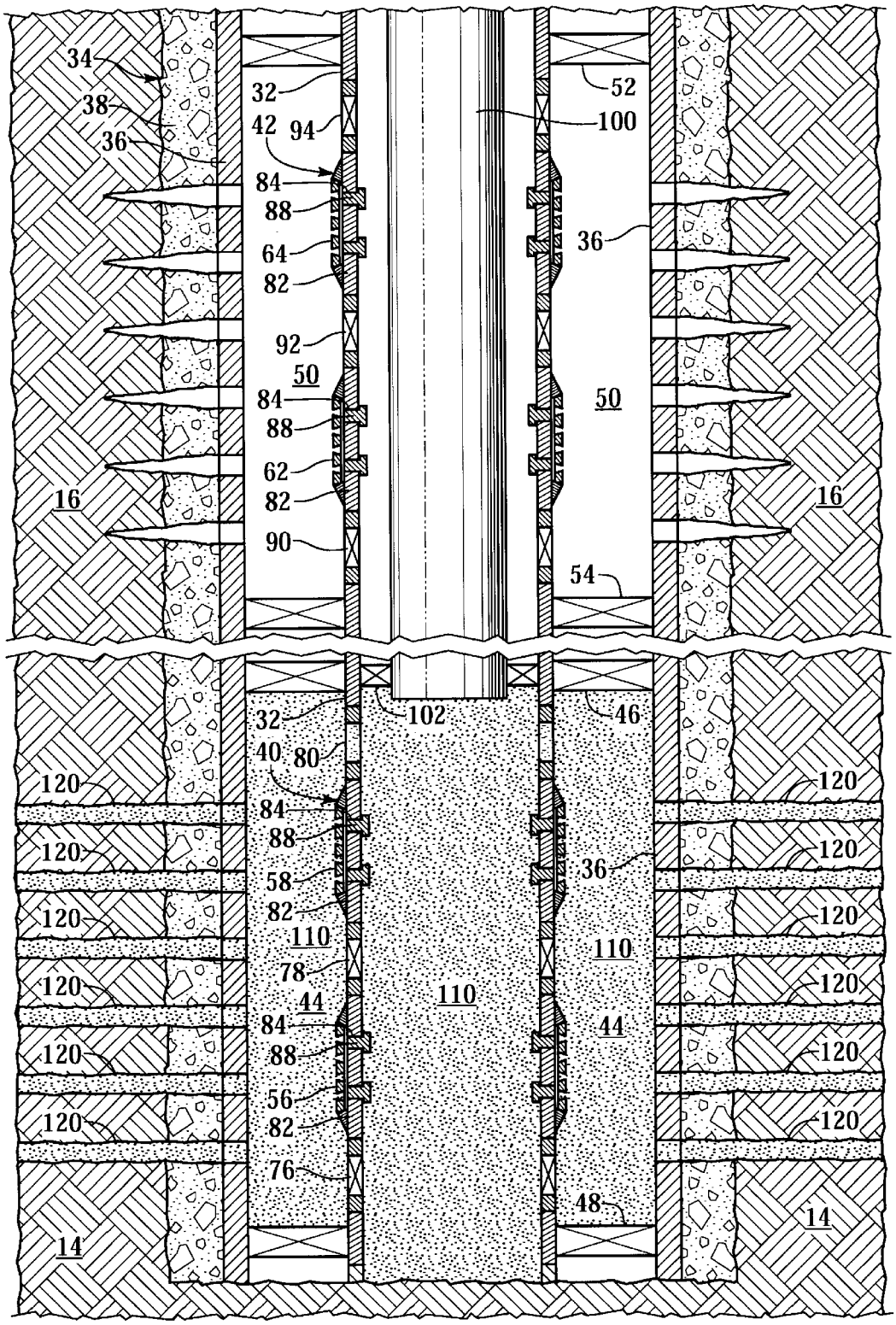
FIG. 7 is a half sectional view of a downhole production environment including two production intervals each having a sand control screen assembly of the present invention associated therewith during a fourth phase of a downhole treatment process.

This process continues from the far end of production interval 44 to the near end of production interval 44. Specifically, referring now to FIG. 7, as treatment fluid continues to be pumped at a high flow rate and in a large volume into screen assembly 40 after screen out occurs around valve 78, the next pressure actuated one-way valve 80 opens. At this point, one-way pressure actuated valve 78 closes. The treatment fluid travels from the interior of screen assembly 40 into interval 44 through pressure actuated one-way valve 80 and into the near end of formation 14 to create fractures 120. Solid agents 110 in the treatment fluid travel into the newly created fracture 120 to prop the fractures open and create a path of high permeability back to wellbore 34. Once these fractures 120 cease to propagate, solid agents 110 from the treatment fluid begin to screen out in the near end of the production interval 44 between sand control screen assembly 40 and casing 36 around valve 80 to form a gravel pack therein which filters particulate matter out of production fluids once production begins.

As no additional valves are available to relieve pressure within sand control screen 40 a pressure spike is measured at the surface. When this occurs, the fracture pack treatment of formation 14 and production interval 44 is complete. Accordingly, the treatment process of the present invention provides for a uniform distribution of treatment fluid along the entire length of formation 14. This is achieved by progressively actuating pressure actuated one-way valves 76, 78, 80 such that the entire formation is fractured.

Even though FIGS. 3–7 present the progressive frac packing of interval 44 as being progressively performed from the far end of the interval to the near end of the interval, those skilled in the art will understand that the progressive treatment process of the present invention can alternatively be performed from the near end of the interval to the far end of the interval. Additionally, it should be understood by those skilled in the art that multiple valves may be actuated simultaneously and that all the valves associated with some formations may be actuated together when the progressive treatment is not required.

Also, it should be noted by those skilled in the art that there are numerous alternatives to pressure actuated one-way valves. For example, in an alternative embodiment, a hard wired or wireless telemetry system may be used to progressively actuate the valves. For example, each valve may be actuated by sending a signal from the surface addressed to a specific valve. This assures a proper progression of the frac pack by preventing any out of sequence activations. The signals may be manually or automatically sent based upon time or the pressure response in screen assembly 40. For example, the signal to actuate the next valve may be sent each time the pressure within screen assembly 40 reaches a particular level or each time the pressure within screen assembly 40 reaches the next preselected pressure increment.

Figure 8:
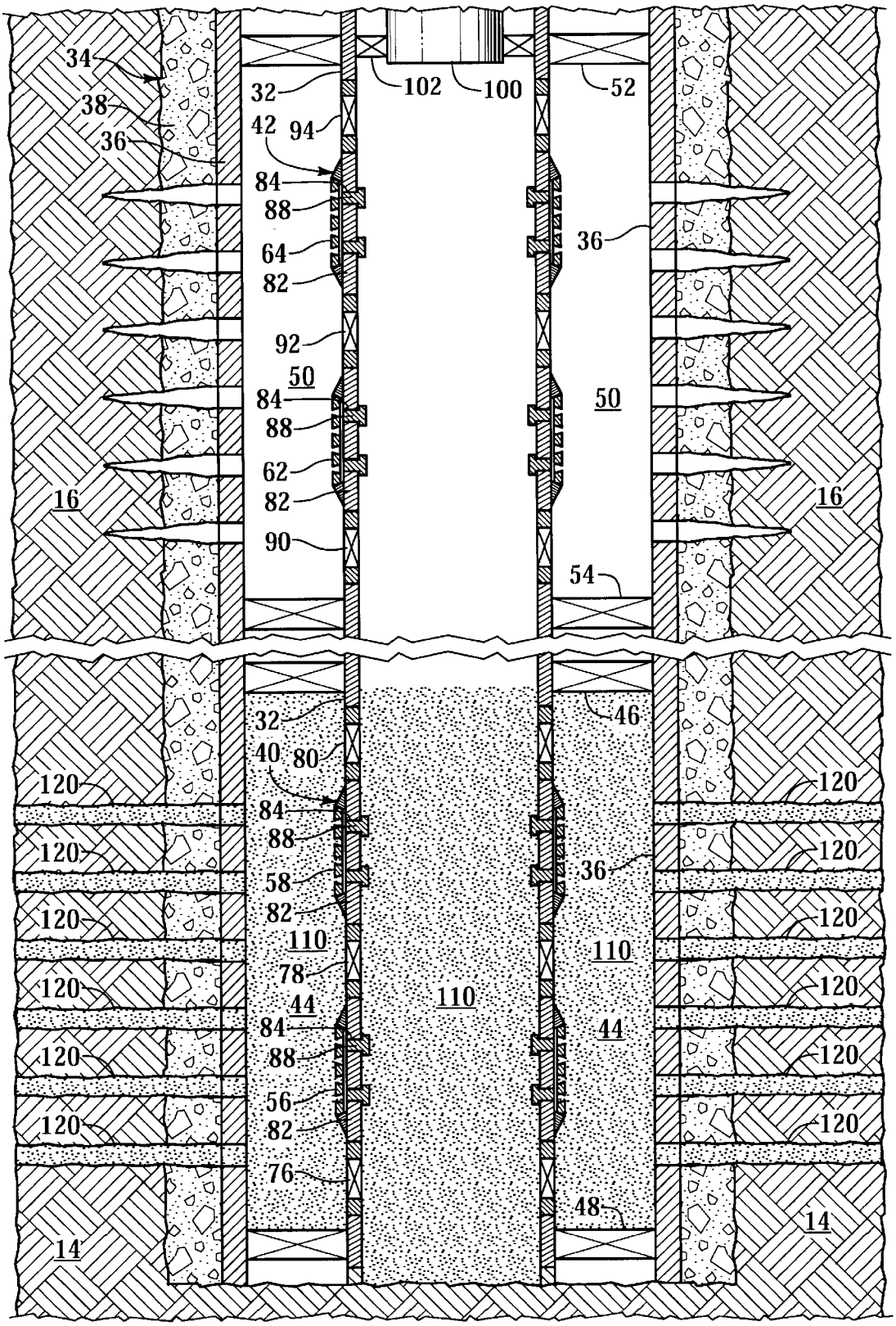
FIG. 8 is a half sectional view of a downhole production environment including two production intervals each having a sand control screen assembly of the present invention associated therewith during a fifth phase of a downhole treatment process.

Referring now to FIG. 8, following completion of the first frac packing operation of formation 14, service tool 100 is operably repositioned to frac pack formation 16. Once service tool 100 is positioned, a treatment process similar to that described above with reference to FIGS. 3–7 but tailored to formation 16 may begin.

Figure 9:
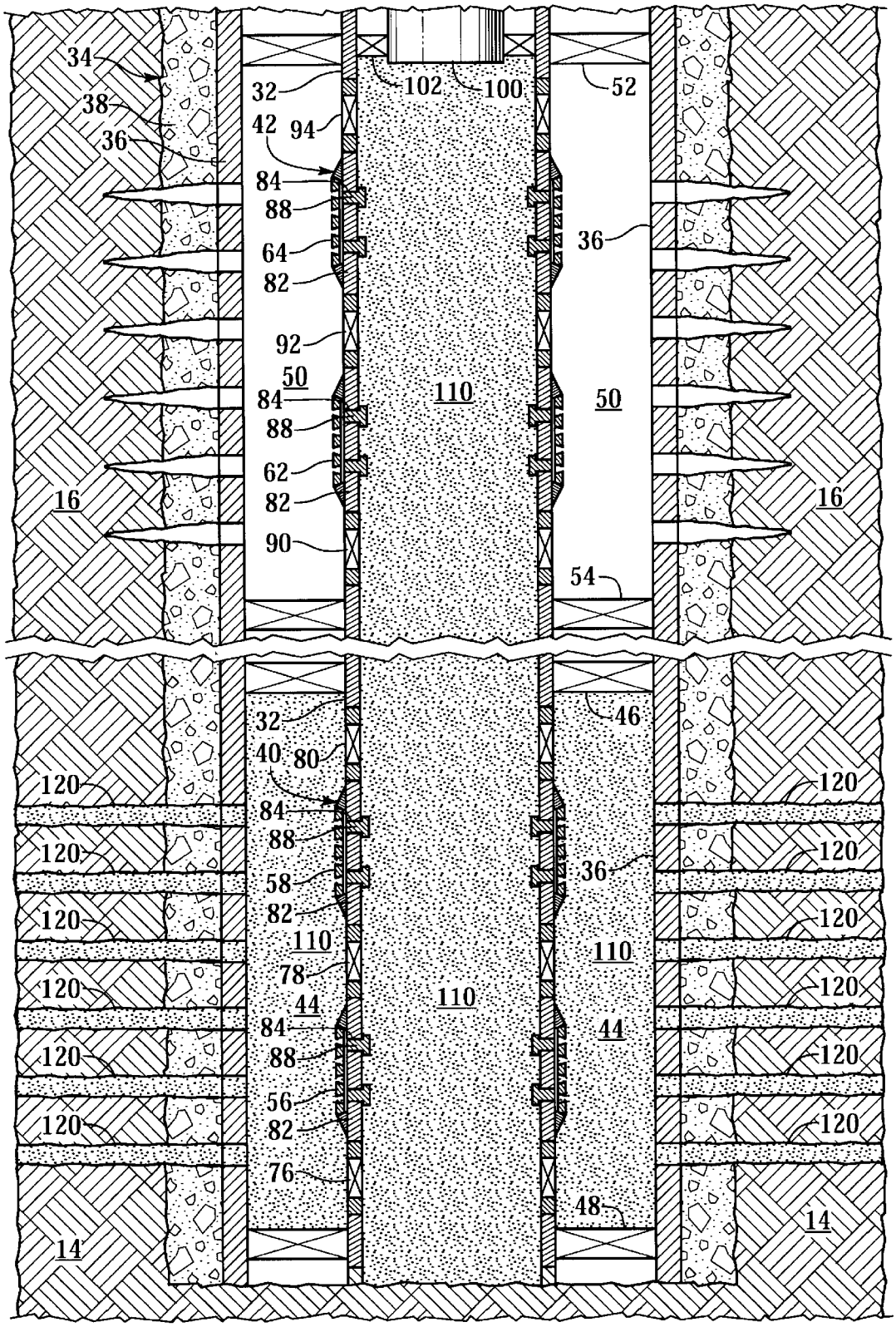
FIG. 9 is a half sectional view of a downhole production environment including two production intervals each having a sand control screen assembly of the present invention associated therewith during a sixth phase of a downhole treatment process.

Referring now to FIG. 9, in the initial phase of the treatment process of the present invention, the interior of sand control screen assembly 42 is filled with a treatment fluid. This is achieved by pumping a treatment fluid down service tool 100 into sand control screen assembly 42. The treatment fluid may be any appropriate fracturing fluid which may be the same as or different from that used to fracture formation 14. Preferably, the treatment fluid includes solid agents 110 such as sand, gravel or proppants.

Figure 10:
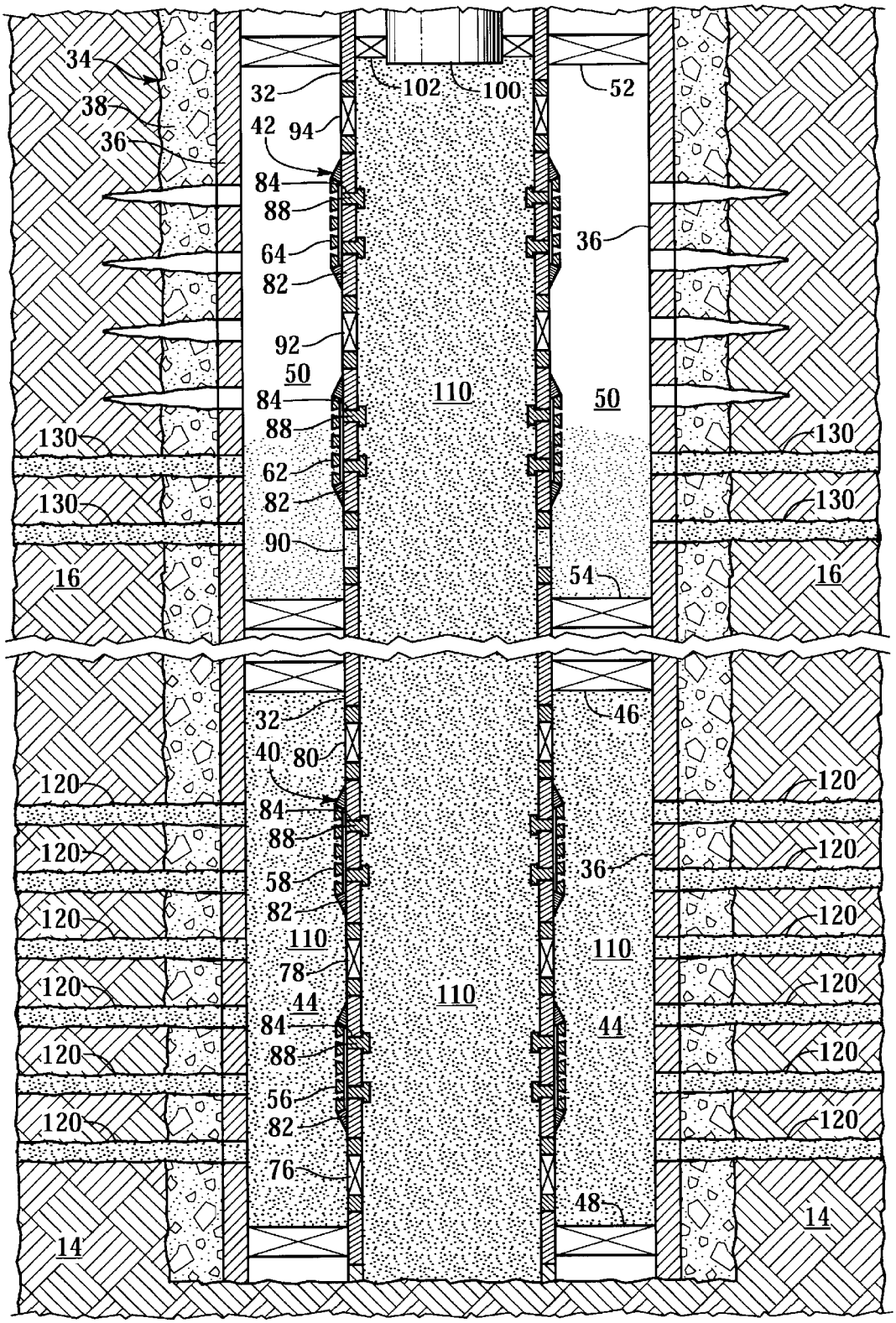
FIG. 10 is a half sectional view of a downhole production environment including two production intervals each having a sand control screen assembly of the present invention associated therewith during a seventh phase of a downhole treatment process.

Referring now to FIG. 10, as the treatment fluid is continuously pumped at a high flow rate and in a large volume into screen assembly 42, pressure begins to build within screen assembly 42. At this point, pressure actuated one-way valve 90 is actuated which allows the treatment fluid to travel form the interior of screen assembly 42 into interval 50 through pressure actuated one-way valve 90. It should be noted that pressure actuated one-way valves 92, 94 are closed.

Treatment fluid flows from the interior of screen assembly 42 through one-way valve 90 into production interval 50 and the far end of formation 16 is fractured, as represented by fractures 130. Solid agents 110 in the treatment fluid travel into the newly created fracture 130 to prop the fractures open and create a path of high permeability back to wellbore 34. As fractures 130 cease to propagate into formation 16, solid agents 110 begin to screen out in production interval 50 between sand control screen assembly 42 and casing 36 around valve 90 and form a gravel pack therein which filters particulate matter out of production fluids once production begins.

Figure 11:
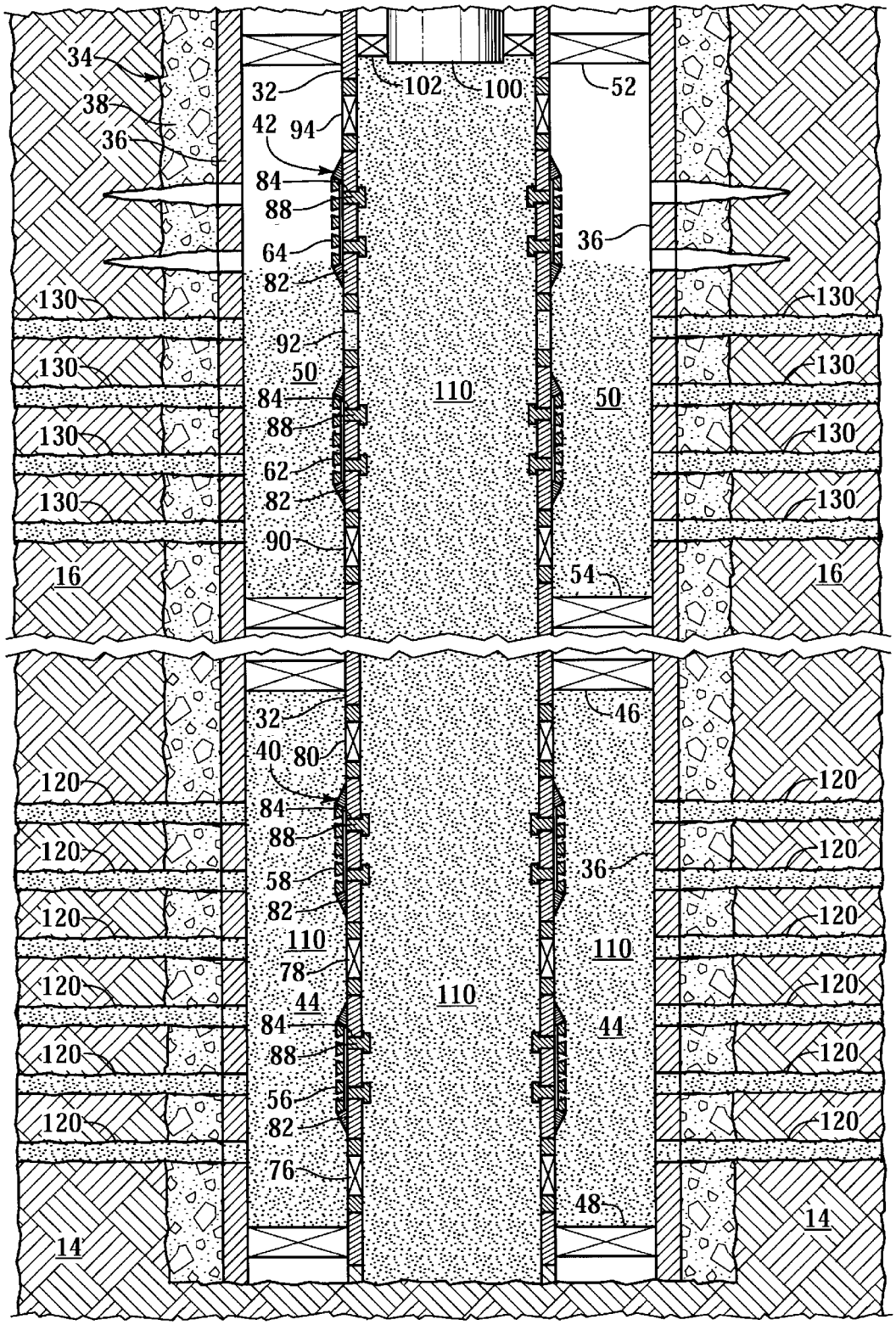
FIG. 11 is a half sectional view of a downhole production environment including two production intervals each having a sand control screen assembly of the present invention associated therewith during an eighth phase of a downhole treatment process.

As this screen out occurs around valve 90 and treatment fluid continues to be pumped at a high flow rate and in a large volume, pressure begins to build causing the process of progressive valve actuation to continue from the far end of interval 50 to the near end of interval 50. Specifically, referring now to FIG. 11, as treatment fluid continues to be pumped at a high flow rate and in a large volume into screen assembly 42, screen out occurs around valve 90 causing the next pressure actuated one-way valve 92 to open. At this point, one-way pressure actuated valve 90 closes. The next section of formation 16 is now fractured as indicated by fractures 130. As these new fractures cease to propagate and screen out occurs around valve 92, the last pressure actuated one-way valve 94 is actuated.

Figure 12:
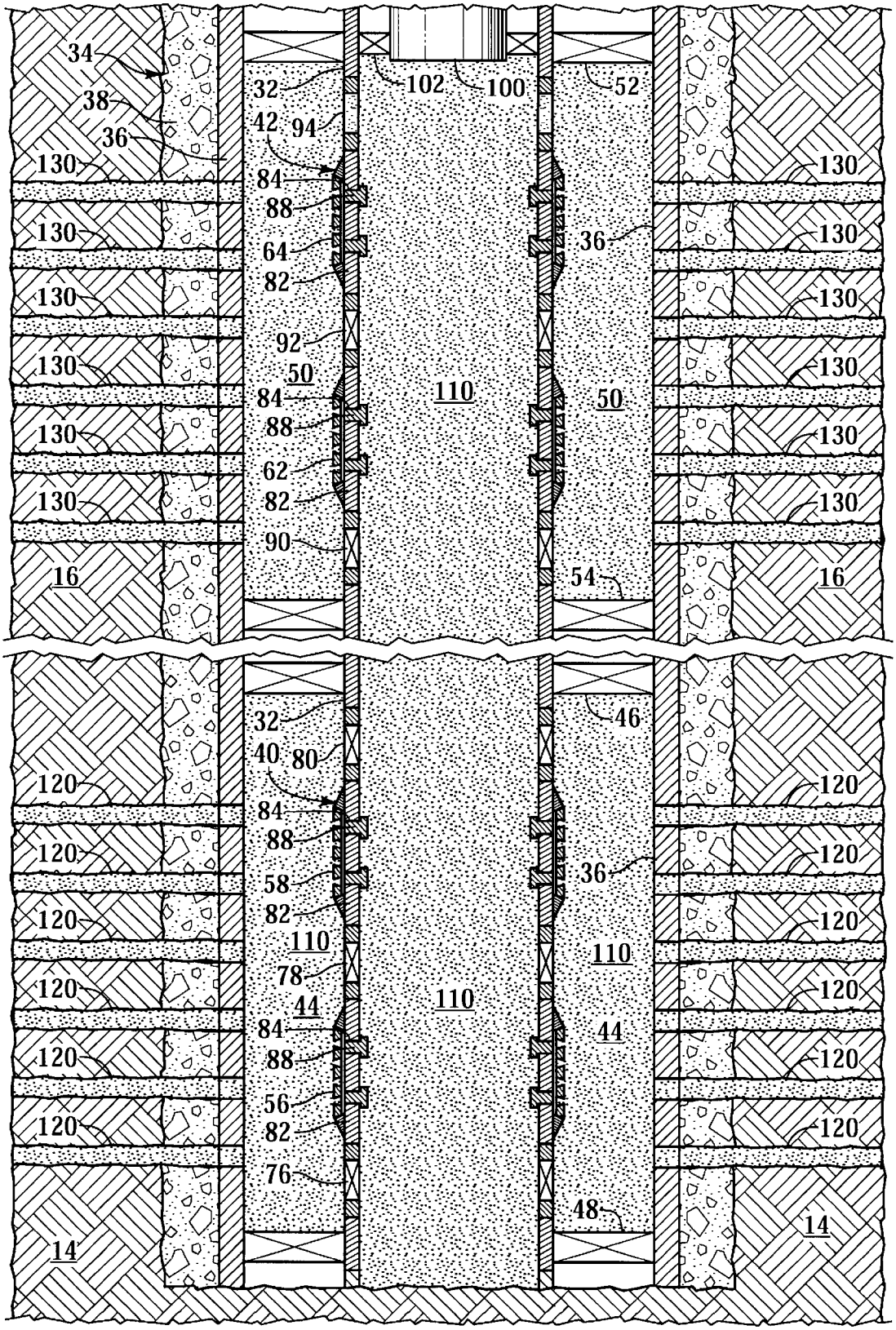
FIG. 12 is a half sectional view of a downhole production environment including two production intervals each having a sand control screen assembly of the present invention associated therewith during a ninth phase of a downhole treatment process.

As best seen in FIG. 12, the treatment fluid travels from the interior of screen assembly 42 into interval 50 through pressure actuated one-way valve 94 and into the near end of formation 16 to create fractures 130. Additionally solid agents 110 in the treatment fluid travel into the newly created fracture 130 to prop the fractures open and create a path of high permeability back to wellbore 34. Once these fractures cease to propagate, solid agents 110 in the treatment fluid begin to screen out in the near end of the production interval 50 between sand control screen assembly 42 and casing 36 around valve 94 to form a gravel pack therein which filters particulate matter out of production fluids once production begins. Solid agents 110 in the treatment fluid fill production interval 50 between sand control screen assembly 42 and casing 36 to form a gravel pack therein and, as no additional valves are available to relieve pressure within sand control screen 42, a pressure spike is measured at the surface. When this occurs, the fracture pack treatment of formation 16 and production interval 50 is complete.

Figure 13:
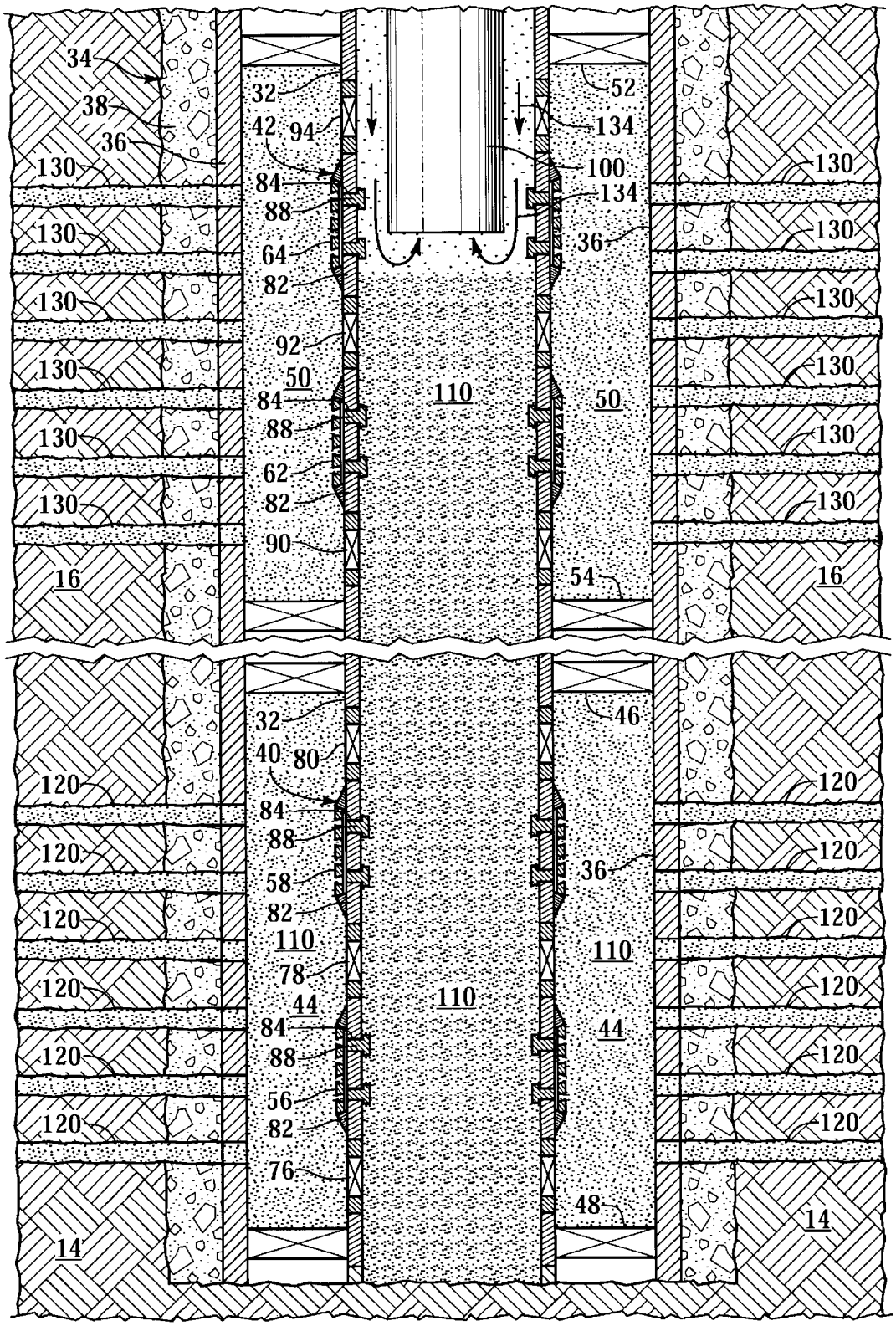
FIG. 13 is a half sectional view of a downhole production environment including two production intervals each having a sand control screen assembly of the present invention associated therewith during a tenth phase of a downhole treatment process.

As seen in FIG. 13, service tool 100 may be used to wash out sand control screen assemblies 40, 42 and work string 32. To wash out sand control screen assemblies 40, 42, liquid is delivered through service tool 100 to mix with solid agents 110. The mixture is allowed to reverse out of work string 32 via the annulus between service tool 100 and work string 32 as indicated by arrows 134. This process of circulating the solid agents to the surface and lowering service tool 100 farther into work string 32 continues until substantially all the solid agents in work string 32 have been removed.

Following the reverse out process, seal members 88 must be removed from base pipes 82. The technique used to remove seal members 88 will depend upon the construction of seal members 88. For example, in the illustrated embodiment seal members 88 comprise a plurality of plugs. If the plugs are formed from an acid reactive material such as aluminum, an acid treatment may be used to remove the plugs. The acid may be pumped into the interior of screen assembly where it will react with the reactive plugs, thereby chemically removing seal members 88. The acid may be returned to the surface via the annulus between service tool 100 and work string 32.

Alternatively, seal members 88 may be mechanically removed. For example, a scrapper mechanism may be used to physically contact seal members 88 and remove seal members 88 from openings 84 as service tool 100 is removed from the interior of screen assemblies 40. As another alternative, if seal members 88 are constructed from propellants, a combustion process may be used to remove seal members 88. Likewise, if seal members 88 are constructed from friable materials such as ceramics, a vibration process, such as sonic vibrations may be used to remove seal members 88. It should be understood by those skilled in the art that other types of seal members 88 may be used to temporarily prevent fluid flow through screen assembly which may be removed by other types of removal process without departing from the principles of the present invention. Once the interior of screen assembly has been washed, seal members 88 have been removed and service tool 100 retrieved, a tubing string (not shown) may be coupled to sand control screen assembly 42 and thereafter the production of formation fluids may begin.

As should be apparent to those skilled in the art, even though FIGS. 3–13 present the treatment of multiple intervals of a wellbore in a vertical orientation with packers at the top and bottom of the production intervals, these figures are intended to also represent wellbores that have alternate directional orientations such as inclined wellbores and horizontal wellbores. In the horizontal orientation, for example, packer 46 is at the heel of production interval 44 and packer 48 is at the toe of production interval 44. Likewise, while multiple production intervals have been described as being treated during a single trip, the methods described above are also suitable for treating a single production interval traversed by a wellbore or may be accomplished in multiple trips into a wellbore. Moreover, it should be understood by one skilled in the art that although the present invention was depicted with two production intervals, the present invention is suitable for use in wellbores having any number of production intervals.

It should be apparent to those skilled in the art that the present invention provides screen assemblies and a method that are capable of uniformly creating fractures along the entire length of multiple production interval in a single trip. Further, the present invention provides for screen assemblies and a method that are capable of stimulating multiple production intervals in a single trip to enhance production. Moreover, the present invention provides for screen assemblies and a method that are capable of preventing fines from entering the production tubing by providing a gravel pack in the production intervals.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A single trip method for fracturing multiple formations traversed by a wellbore comprising the steps of:

locating a first screen assembly having a plurality of first valves within the wellbore proximate a first formation;

locating a second screen assembly having a plurality of second valves within the wellbore proximate a second formation;

operably positioning a service tool proximate the first formation;

injecting a first fracture treatment fluid through the service tool into the interior of the first screen assembly;

progressively operating the first valves to establish fluid communication from the interior to the exterior of the first screen assembly to progressively fracture the first formation;

repositioning the service tool proximate the second formation;

injecting a second fracture treatment fluid into the interior of the second screen assembly; and progressively operating the second valves to establish fluid communication from the interior to the exterior of the second screen assembly to progressively fracture the second formation.

2. The method as recited in claim 1 wherein the steps of injecting the first fracture treatment fluid and injecting the second fracture treatment fluid further comprise injecting fracture treatment fluids having substantially the same composition.

3. The method as recited in claim 1 wherein the steps of injecting the first fracture treatment fluid and injecting the second fracture treatment fluid further comprise injecting fracture treatment fluids having different compositions.

4. The method as recited in claim 1 wherein the steps of injecting the first fracture treatment fluid and injecting the second fracture treatment fluid further comprise injecting fracture treatment fluids having substantially the same viscosity.

5. The method as recited in claim 1 wherein the steps of injecting the first fracture treatment fluid and injecting the second fracture treatment fluid further comprise injecting fracture treatment fluids having different viscosities.

6. The method as recited in claim 1 wherein the steps of injecting the first fracture treatment fluid and injecting the second fracture treatment fluid further comprise injecting the first and second fracture treatment fluids at substantially the rate.

7. The method as recited in claim 1 wherein the steps of injecting the first fracture treatment fluid and injecting the second fracture treatment fluid further comprise injecting the first and second fracture treatment fluids at different rates.

8. The method as recited in claim 1 wherein the steps of injecting the first fracture treatment fluid and injecting the second fracture treatment fluid further comprise injecting treatment fluids having solid agents therein.

9. The method as recited in claim 8 further comprising the step of propping the fractures in the first and second formations with the solid agents.

10. The method as recited in claim 8 further comprising the step of packing the wellbore adjacent to the first and second formations with the solid agents.

11. The method as recited in claim 1 further comprising preventing the flow of fluids from the exterior to the interior of the first and second screen assemblies through the first and second valves.

12. The method as recited in claim 1 further comprising preventing the flow of fluids between the interior and the exterior of the first and second screen assemblies through openings in base pipes of the first and second screen assemblies with seal members.

13. The method as recited in claim 12 further comprising the step of combustibly removing the seal members after fracturing the second formation.

14. The method as recited in claim 12 further comprising the step of sonically removing the seal members after fracturing the second formation.

15. The method as recited in claim 12 further comprising the step of chemically removing the seal members after fracturing the second formation.

16. The method as recited in claim 12 further comprising the step of mechanically removing the seal members after fracturing the second formation.

17. The method as recited in claim 1 wherein the step of progressively operating the first valves to establish fluid communication from the interior to the exterior of the first screen assembly further comprises progressively operating the first valves from a far end to a near end of the first screen assembly.

18. The method as recited in claim 1 wherein the step of progressively operating the first valves to establish fluid communication from the interior to the exterior of the first screen assembly further comprises progressively operating the first valves from a near end to a far end of the first screen assembly.

19. The method as recited in claim 1 wherein the step of progressively operating the second valves to establish fluid communication from the interior to the exterior of the second screen assembly further comprises progressively operating the second valves from a far end to a near end of the second screen assembly.

20. The method as recited in claim 1 wherein the step of progressively operating the second valves to establish fluid communication from the interior to the exterior of the second screen assembly further comprises progressively operating the second valves from a near end to a far end of the second screen assembly.

21. The method as recited in claim 1 wherein the steps of progressively operating the first and second valves further comprise progressively operating the first and second valves in response to pressure.

22. The method as recited in claim 1 wherein the steps of progressively operating the first and second valves further comprise progressively operating the first and second valves via wireless telemetry.

23. The method as recited in claim 1 wherein the steps of progressively operating the first and second valves further comprise progressively operating the first and second valves via a direct electrical connection.

24. The method as recited in claim 1 wherein the steps of progressively operating the first and second valves further comprise progressively operating the first and second valves hydraulically.

25. A single trip method for fracturing multiple formations traversed by a wellbore comprising the steps of:

locating a first screen assembly having a plurality of first valves within the wellbore proximate a first formation;

locating a second screen assembly having a plurality of second valves within the wellbore proximate a second formation;

operably positioning a service tool proximate the first formation;

injecting a first fracture treatment fluid through the service tool into the interior of the first screen assembly;

progressively operating the first valves in response to pressure within the first screen assembly to establish fluid communication from the interior to the exterior of the first screen assembly to progressively fracture the first formation;

repositioning the service tool proximate the second formation;

injecting a second fracture treatment fluid into the interior of the second screen assembly; and progressively operating the second valves in response to pressure within the second screen assembly to establish fluid communication from the interior to the exterior of the second screen assembly to progressively fracture the second formation.

26. The method as recited in claim 25 wherein the steps of injecting the first fracture treatment fluid and injecting the second fracture treatment fluid further comprise injecting fracture treatment fluids having substantially the same composition.

27. The method as recited in claim 25 wherein the steps of injecting the first fracture treatment fluid and injecting the second fracture treatment fluid further comprise injecting fracture treatment fluids having different compositions.

28. The method as recited in claim 25 wherein the steps of injecting the first fracture treatment fluid and injecting the second fracture treatment fluid further comprise injecting fracture treatment fluids having substantially the same viscosity.

29. The method as recited in claim 25 wherein the steps of injecting the first fracture treatment fluid and injecting the second fracture treatment fluid further comprise injecting fracture treatment fluids having different viscosities.

30. The method as recited in claim 25 wherein the steps of injecting the first fracture treatment fluid and injecting the second fracture treatment fluid further comprise injecting the first and second fracture treatment fluids at substantially the rate.

31. The method as recited in claim 25 wherein the steps of injecting the first fracture treatment fluid and injecting the second fracture treatment fluid further comprise injecting the first and second fracture treatment fluids at different rates.

32. The method as recited in claim 25 wherein the steps of injecting the first fracture treatment fluid and injecting the second fracture treatment fluid further comprise injecting treatment fluids having solid agents therein.

33. The method as recited in claim 32 further comprising the step of propping the fractures in the first and second formations with the solid agents.

34. The method as recited in claim 32 further comprising the step of packing the wellbore adjacent to the first and second formations with the solid agents.

35. The method as recited in claim 25 further comprising preventing the flow of fluids from the exterior to the interior of the first and second screen assemblies through the first and second valves.

36. A single trip method for fracturing multiple formations traversed by a wellbore comprising the steps of:

locating a first screen assembly having a plurality of first valves within the wellbore proximate a first formation;

locating a second screen assembly having a plurality of second valves within the wellbore proximate a second formation;

operably positioning a service tool proximate the first formation;

injecting a treatment fluid having a first composition through the service tool into the interior of the first screen assembly;

progressively operating the first valves to establish fluid communication from the interior to the exterior of the first screen assembly to progressively fracture the first formation;

repositioning the service tool proximate the second formation;

injecting a treatment fluid having a composition that is different from the first composition into the interior of the second screen assembly; and progressively operating the second valves to establish fluid communication from the interior to the exterior of the second screen assembly to progressively fracture the second formation.

37. The method as recited in claim 36 wherein the steps of injecting a treatment fluid having a first composition and injecting a treatment fluid having a composition that is different from the first composition further comprise injecting treatment fluids having solid agents therein.

38. The method as recited in claim 37 further comprising the step of propping the fractures in the first and second formations with the solid agents.

39. The method as recited in claim 37 further comprising the step of packing the wellbore adjacent to the first and second formations with the solid agents.

40. The method as recited in claim 36 further comprising preventing the flow of fluids from the exterior to the interior of the first and second screen assemblies through the first and second valves.

41. The method as recited in claim 36 wherein the steps of progressively operating the first and second valves further comprise progressively operating the first and second valves in response to pressure.

42. A single trip method for fracturing multiple formations traversed by a wellbore comprising the steps of:

locating a first screen assembly having a plurality of first valves within the wellbore proximate a first formation;

locating a second screen assembly having a plurality of second valves within the wellbore proximate a second formation;

operably positioning a service tool proximate the first formation;

injecting a treatment fluid having a first viscosity through the service tool into the interior of the first screen assembly;

progressively operating the first valves to establish fluid communication from the interior to the exterior of the first screen assembly to progressively fracture the first formation;

repositioning the service tool proximate the second formation;

injecting a treatment fluid having a viscosity that is different from the first viscosity into the interior of the second screen assembly; and progressively operating the second valves to establish fluid communication from the interior to the exterior of the second screen assembly to progressively fracture the second formation.

43. The method as recited in claim 42 wherein the steps of injecting a treatment fluid having a first viscosity and injecting a treatment fluid having a viscosity that is different from the first viscosity further comprise injecting treatment fluids having solid agents therein.

44. The method as recited in claim 43 further comprising the step of propping the fractures in the first and second formations with the solid agents.

45. The method as recited in claim 43 further comprising the step of packing the wellbore adjacent to the first and second formations with the solid agents.

46. The method as recited in claim 42 further comprising preventing the flow of fluids from the exterior to the interior of the first and second screen assemblies through the first and second valves.

47. The method as recited in claim 42 wherein the steps of progressively operating the first and second valves further comprise progressively operating the first and second valves in response to pressure.

48. A single trip method for fracturing multiple formations traversed by a wellbore comprising the steps of:

locating a first screen assembly having a plurality of first valves within the wellbore proximate a first formation;

locating a second screen assembly having a plurality of second valves within the wellbore proximate a second formation;

operably positioning a service tool proximate the first formation;

injecting a first treatment fluid at a first rate through the service tool into the interior of the first screen assembly;

progressively operating the first valves to establish fluid communication from the interior to the exterior of the first screen assembly to progressively fracture the first formation;

repositioning the service tool proximate the second formation;

injecting a second treatment fluid at a rate that is different from the first rate into the interior of the second screen assembly; and progressively operating the second valves to establish fluid communication from the interior to the exterior of the second screen assembly to progressively fracture the second formation.

49. The method as recited in claim 48 wherein the steps of injecting the first and second treatment fluids further comprise injecting treatment fluids having solid agents therein.

50. The method as recited in claim 49 further comprising the step of propping the fractures in the first and second formations with the solid agents.

51. The method as recited in claim 49 further comprising the step of packing the wellbore adjacent to the first and second formations with the solid agents.

52. The method as recited in claim 48 further comprising preventing the flow of fluids from the exterior to the interior of the first and second screen assemblies through the first and second valves.

53. The method as recited in claim 48 wherein the steps of progressively operating the first and second valves further comprise progressively operating the first and second valves in response to pressure.

* * * * *